US005460330A

United States Patent [19]

Steeb et al.

[11] Patent Number: 5,460,330

[45] Date of Patent: Oct. 24, 1995

[54] FUEL OIL BURNER WITH FUEL HEATER AND ELECTROMAGNETIC

[75] Inventors: Walter Steeb, Döhlau-Tauberlitz; Werner Döhla, Gefrees; Dietrich Brunner, Selb, all of Germany

[73] Assignee: Rapa Rausch & Pausch Elektrotechnische Spezialfabrik GmbH, Selb, Germany

[21] Appl. No.: 178,280

[22] PCT Filed: May 11, 1993

[86] PCT No.: PCT/EP93/01163

§ 371 Date: Feb. 2, 1994

§ 102(e) Date: Feb. 2, 1994

[87] PCT Pub. No.: WO93/23705

PCT Pub. Date: Nov. 25, 1993

[30] Foreign Application Priority Data

May 12, 1992 [DE] Germany ..... 42 15 995.4

[51] Int. Cl.[6] ..... F23D 11/44; F23D 11/36

[52] U.S. Cl. ..... 239/133; 239/135

[58] Field of Search ..... 239/132–135

[56] References Cited

U.S. PATENT DOCUMENTS

| | | | |
|---|---|---|---|
| 2,375,649 | 5/1945 | Hawley . | |
| 2,397,988 | 4/1946 | Senniger . | |
| 3,090,420 | 5/1963 | Sacco | 239/133 |
| 3,408,008 | 10/1968 | Cocks | 239/135 |
| 4,301,966 | 11/1981 | Schwarz | 239/135 |
| 4,651,928 | 3/1987 | Schmidt | 239/133 |
| 5,069,834 | 12/1991 | Babitzka | 264/24 |
| 5,090,895 | 2/1992 | Jensen et al. | 431/208 |

FOREIGN PATENT DOCUMENTS

| | | | |
|---|---|---|---|
| 2360044 | 3/1978 | France | 239/133 |
| 2138777 | 2/1973 | Germany . | |
| 2360460 | 6/1975 | Germany . | |
| 3434840 | 4/1986 | Germany . | |
| 4112627 | 3/1992 | Germany . | |
| 510848 | 7/1971 | Switzerland . | |
| 2052041 | 1/1981 | United Kingdom . | |

*Primary Examiner*—Karen B. Merritt
*Attorney, Agent, or Firm*—Jordan and Hamburg

[57] ABSTRACT

A fuel oil burner with a fuel heater and an electromagnetic valve has a pipe member with an external diameter, a first end portion adjacent a fuel feed duct and a second end portion adjacent a nozzle. The first end portion is connected with the fuel feed duct and the second end portion is connected with the nozzle. In the pipe member are members for conducting and for preheating the fuel. The electromagnetic stop valve is arranged between the preheater and the nozzle. Electrical contacts adapted for the preheater and the stop valve are provided at the pipe member in the vicinity of the first end portion. Electrical connections to the stop valve and the preheater are within the external diameter of the pipe member. The fuel oil burner is very compact, compatible and reliable.

13 Claims, 1 Drawing Sheet

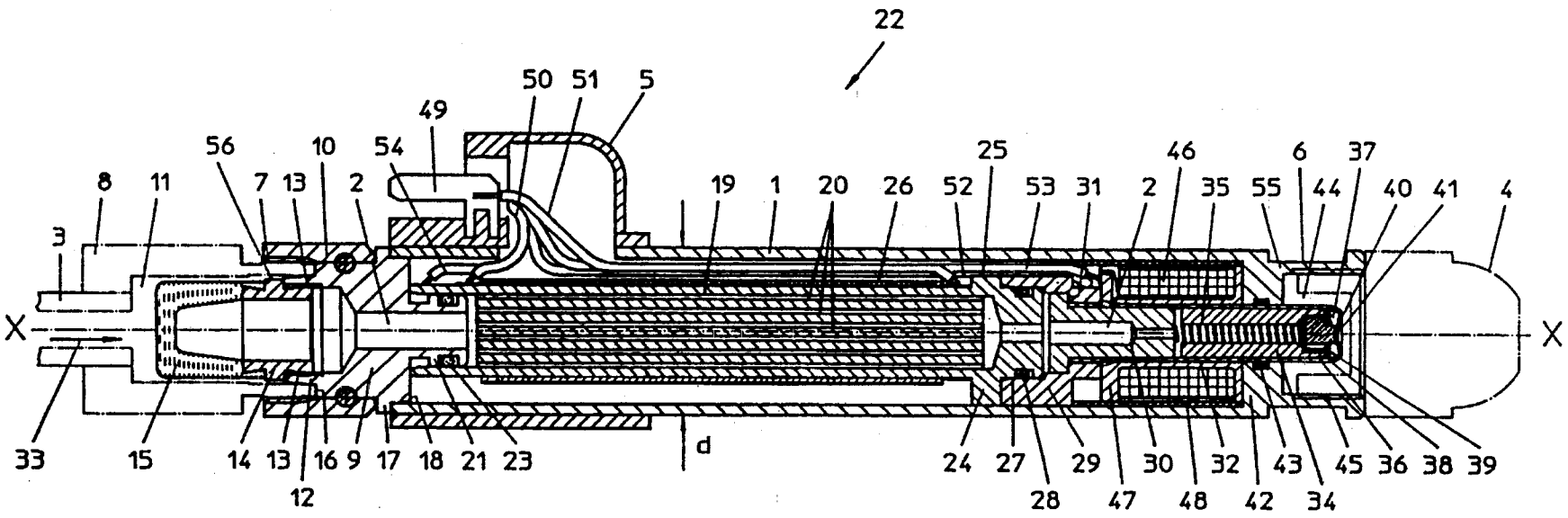
X
4
41
40
37
6
55
35
46
2
31
53
25
52
26
20
1
19
5
51
50
49
54
2
10
13
7
56
11
8
3
X
39
38
36
45
34
43
42
32
48
30
47
29
28
27
24
22
d
23
21
18
17
9
16
12
13
14
15
33

FUEL OIL BURNER WITH FUEL HEATER AND ELECTROMAGNETIC

The invention relates to a burner nozzle assembly used in atomisation fuel oil burners of the type which include an electric fuel heater and electromagnetic stop valve.

There is already known a fuel oil continuous heater for burning light oil or extra-light oil (DE 27 38 377) which provides favorable relationship between fuel oil temperature, oil feed pressure, the burner nozzle to be selected and the heat obtained, which furthermore prevents dripping. To this end the fuel oil pressure continuous heater is provided with an electrical heater, a fuel oil duct coil which encloses the heater and ends in a nozzle chamber and a stop valve, preferably a magnetically operating valve, which is arranged in said nozzle chamber, said stop valve is preceded, in the oil feed direction by a stop thermovalve. Apart from the fact that the arrangement of the heating centrally and the fuel oil duct externally is, considered from a thermo-technical viewpoint, disadvantageous, the coil embodiment of the fuel duct in the fuel oil continuous heater is expensive. This has an unfavorable effect on the structure of the oil continuous heater and renders the latter bulky which is of particular importance when special and definite installation spaces and standard measures are given for a heating plant. In addition thereto, no detail is provided regarding manner of arrangement and embodiment of the magnetic valve or the electric connections for the heater and the magnetic valve. When the device is used with a blower, the diameter variations deteriorate the air stream.

Furthermore, a valve for burners of the atomisation type for fluid fuels is known from DE 24 38 957 B2 which is embodied as a magnetic valve and the housing of which is the burner nozzle holder. The valve has a nozzle which is screwed in combination with a filter in opposition to the magnetic valve into an expansion of the fuel oil exit duct. A fuel oil preheater is not provided in that case. Furthermore, the electric contacts are externally provided on the nozzle holder in the vicinity of the nozzle. They are quite close to the burner flame and, hence, subject to heat effect. In addition thereto they form an obstacle when the nozzle assembly is installed into a heating plant. Furthermore, the housing of the magnetic valve has a larger diameter compared to the nozzle holder which unfavorably affects the blower air stream. Finally, DE 38 00 300 A1 discloses a fuel oil pump device for an atomising burner in which a nozzle assembly including a preheater is connected via a magnetic valve to the the forward pipe of a pump. Within the nozzle assembly there is arranged between the preheater and the nozzle, a stop valve which cooperates with a second stop valve connected to the magnetic valve in order to eliminate any afterspray or dropping. The requirements necessary in this case and which are illustrated by the arrangement of two additional stop valves and a bypass, are considerable.

It is an object of the present invention to combine the advantages of the known devices and to avoid the disadvantages of the same.

Consequently, it is an object of the invention to provide a low cast nozzle arrangement which effectively ensures the required viscosity of the fuel oil and eliminates any dropping ("pre" or "after") from the burner nozzle and which, at the same time, is of a compact and compatible embodiment which permits installation in new and also in existing atomisation burners.

According to the invention said object is realised by the features of a pipe member connected at a first end thereof by a connector with a fuel feed duct and at a second opposite end with a nozzle by means of a second connector, there being means for conducting fuel through the pipe member. An electric preheater is provided to heat fuel in the fuel conducting means and an electromagnetic stop valve is provided in the said conducting means as well with the preheater being arranged between the stop valve and the pipe member first end. Electrical contacts are provided for the preheater and the stop valve these being adjacent the first connector. Electrical connections connecting the contacts with the stop valve are carried in the pipe member but external of the preheater. The combination of the features permits a burner- nozzle assembly geometry which is of conventional shape and, hence, does without external electric connections and contacts in the nozzle vicinity which otherwise would endanger safe operation. Further the assembly avoids negative effect on the blower air stream, and is at a desired compact construction.

The electrical connections between the electrical contacts and the stop valve are provided in the internal pipe or in external pipe wall structure, for example, in axial grooves. It is ensured that the external sizes and geometry of the pipe are not affected. As concerns the electrical contacts, these can be provided within at least one housing laterally attached to the fuel pipe end portion remote from the nozzle. By simplifying the electrical circuit it is feasible to provide a common return conductor and a common protective ground for the preheater and for the magnetic coil. A two-stage heating of the burner nozzle assembly is obtainable by employing the magnetic coil of the stop valve for heating the burner nozzle assembly and the nozzle, respectively. Due to the kind of application it is advantageous when the preheater is detachably arranged in the pipe. It is a further advantage to embody the stop valve as a magnetic valve the coil of which is operated with a safety reduced low voltage. This permits use of comparatively thick wires for the coil windings which, in turn, increases the reliability of operation.

It is advantageous to embody the pipe as a plural part component for easy assembly, when required electrical plug connections are provided between the individual pipe parts. In this case at least the part of pipe which encloses the stop valve is made of retro-magnetic material thus enhancing the magnetic flux across the stop valve and simplifying its operation.

In order that the preheater can also heat the nozzle at least one heat conducting element is provided between the nozzle and the preheater which element is preferably embodied as a copper shell which encloses the stop valve. To avoid any affect on the magnetic flux by the copper shell, the end portions of the shell are slotted. The shell made of heat conducting material can be substituted for bars or stripes which end at the preheater and the nozzle or in the vicinity of the latter. Most suitably the heat conducting elements are arranged in the vicinity of the pipe wall near the stop valve. Preferably the wall of the pipe possesses at least one closeable opening for easy assembly or disassembly , when required, of individual parts such as the preheater or the stop valve, than it would be where a closed pipe is used. Advantageously the pipe and the fuel duct are connected with one another via a coupling nut and a corresponding threaded sleeve, which can be an internal or external thread of the connection piece of the pipe. Similarly, the nozzle can be connected to the pipe via a respective internal or external thread on the connection member of the pipe or on the nozzle itself.

As concerns the purity of the fuel atomised through the nozzle it is a considerable advantage to provide a filter in the fuel duct. The filter is preferably mounted in that end portion of the pipe which is in opposition to the fuel feed duct. It is, however, also feasible to mount the filter on the nozzle side of the pipe, that is, directly "pre"-positioned to the nozzle. In the event, adequate space for the installation of the nozzle has to be provided.

The central and coaxial fuel duct i n the nozzle assembly consists of a plurality of axially parallel channels or of one channel filled with heat conducting members preferably enclosed by the preheater. Heating elements of the preheater can be heating coils or rods or a negative resistance conductor.

In order that the invention may be more readily understood reference is made to the accompanying simple FIGURE of which illustrates diagrammatically and by way of example one embodiment thereof, the FIGURE being a longitudinal section view along the geometrical axis X—X.

A nozzle assembly 22 comprises a pipe 1, preferably of cylindrical cross-section , made of ferromagnetic material, which substantially has the same diameter d along its entire length and includes a coaxial fuel duct 2, the diameter of the latter varying along the length of the pipe 1. Said pipe 1 is connected to a fuel feed duct 3, on its one end portion, and to a nozzle 4, on its other end portion. In the vicinity of the fuel feed duct 3 the pipe 1 is provided with a housing 5 for receiving electrical plug contacts, and in the vicinity of the nozzle 4 with a functional recess 6 in the shape of a nut face. A connection piece 8 is adapted to secure the pipe 1 and fuel feed duct 3 fast to the connection piece 8 which, via an external thread 7, meshes with the internal thread of a connection nut 10 which, in turn, is rotatably seated on an intermediate member 9. The connection piece 8 has an enlargement 11 into which the intermediate member 9 projects via an internal thread portion 12 which, in turn, meshes with a thread 13 of a carrier member 14 for a filter 15. Member 14 has nut faces 56 and is nondisplaceably connected to the filter 15. The intermediate member 9 has a shoulder 16 against which the front face of the connection piece 8 is pressed when the connection nut 10 is screwed on. Furthermore, the intermediate member 9 is provided with a sleeve 17 and a cylindrical face 18 via which the pipe 1 is non-rotatably connected to the intermediate member 9 so that its respective front face abuts against the face of the sleeve 17. In the interior of the pipe 1, a cylindrical preheater 19 is arranged having channels 20 in parallel to the axis X—X. The end portion of said preheater is in opposition to the intermediate member 9 being slid over a fitting portion 21 of the intermediate member 9. An annular seal 23 is incorporated into the surface of the fitting portion 21. On its other end portion, the preheater 19 is fitted into the pipe 1 via a collar 24 which has at least one recess 25. In the range of the channels 20, the preheater 19 is enclosed by one heating element 26 which consists of at least one heating coil and is adapted to heat the preheater 19. The end portion of the preheater 19 which is in the vicinity of the nozzle 4 is constituted of a cylindrical fitting area 27 into which a seal 28 is inserted, and abuts against a stepped annular member 29. A short distance from the nozzle side front face of the preheater 19, a passage member 30 is embodied and arranged in such a manner that it projects with one end portion into the stepped annular member 29 and via a shoulder 31 abuts against one step of the stepped annular member 29, the passage member being enclosed by a guide tube 32. The guide tube encloses, considered in the direction indicated by an arrow 33 and subsequent to the passage member 30, an annular armature 34 in which the fuel duct 2 part has a greater diameter as compared to that of the passage member 30 armature 34 includes a helical spring 35 which abuts via one end portion thereof against the nozzle side front face of the passage member The other end portion of the helical spring 35 acts upon a cap 37 which is laterally provided with recesses 36 for the fuel flow. The cap 37 is arranged in a bulge 38 of the fuel duct 2 in the armature 34 and abuts against a flange 39 of the armature 34. The guide tube 32 has in its nozzle side end portion, a neck 40 with an orifice 41 which is opened or tightly closed by a cap 37, The pipe 1 is provided in its interior in the vicinity of its nozzle side end portion with a collar 42 which radially stabilizes the guide tube 32, to this end a seal 43 is provided between the collar 42 and the guide tube 33. The collar 42 is, considered in direction of the nozzle 4, followed by a cavity 44 constituted by a connection member 55 into which the nozzle 4 can be screwed via its external thread. Between the stepped annular member 29 and the collar 42 the guide tube 32 is enclosed in a housing 47 which contains a magnetic coil 46 which together with the armature 34, the spring 35, the cap 37, and the orifice neck 40 constitute a magnetic valve. A copper shell 48 is provided between the magnet coil housing 47 and the inner wall part of the pipe 1 to transfer the heat from the preheater 19 to the nozzle side end portion of the pipe 1. Power supply lines 50 to 53 are provided from the plug contacts 49 in the housing 5 to the heating coil 26 and the magnet coil 46, respectively, and from a protective contact 54 to the cylindrical preheater 19, these lines being exclusively run within the pipe 1. The power supply lines 50 to 52 are return wires which run to a common contact in the housing 5. The entire lines are protected in this manner. Thus any additional contacts on and changes of the diameter of the pipe 1 are avoided. In operation: in the OFF-state no voltage is applied across the contacts 49 of the nozzle assembly 22. The armature 34 with the cap 37 are in the position shown in the drawing; the cap 37 closes the orifice 41 in the neck 40. Hence, no fuel is permitted to enter the nozzle 4 and no atomisation takes place. Since the cavity 44 between the magnetic valve and the nozzle 4 is kept considerably small a dropping ("pre" or "after") is reliably eliminated. When the fuel oil atomisation burner, which involves the nozzle assembly 22, is switched ON, a voltage is applied across the heating coil 26 of the preheater 19 and the latter is healed for a certain time. When a preset temperature is arrived at and after a definite pre-ventilation Lime has elapsed a voltage is applied across the magnetic coil 46 of the magnetic valve, the armature 34 is attracted towards the passage 30 and, consequently, the orifice 41 is opened so that the heated fuel oil flows via the duct 2, the channels 20, and the lateral recess 36 to the nozzle 4. The electrical means for controlling the voltage are not represented for the sake of simplicity. In the ON-state, when the magnetic valve is operative and the armature 34 attracted by the force of the magnetic coil the magnetic valve is simultaneously employed to heat the nozzle portion of the nozzle assembly 22 so that the heating power of the preheater can be reduced. Since at least in the vicinity of the magnetic valve (which comprises the members 34, 35, 37, 40, 46, 47) the pipe 1 consists of magnetiseable material, it is included it, to the magnetic circuit so that the magnetic flux uninhibitedly flows through the armature 34, the collar 42, the orifice neck 40, the stepped annular member 29, the passage 30, and back to the armature 34. When the fuel oil atomisation burner to which the nozzle assembly belongs is switched OFF, the cap 37 again closes the orifice 41 and the fuel oil is prevented from flowing from the duct 2 in the interior of the pipe 1 into the cavity 44 and, hence, into the nozzle 4.

The scope of the invention is not restricted to the embodiment illustrated. So it is feasible to install the filter 15 adjacent the nozzle 4 instead of the preheater 19. In certain applications it is feasible to remove the preheater 19. A further alternative is to replace the plurality of channels 20 by a single channel filled with heat conducting members (balls) in such a manner that spaces are constituted between the contact points. Instead of being provided in the interior of the pipe 1, but still externally of the fuel duct 2, at least a part of the electric lines 50 to 54 are adapted to run in grooves which are provided substantially in parallel to the axis X—X, either in the external or in the internal wall of the pipe 1 from the housing 5 to the respective contacts of the heater 26 and coils 46, respectively. In any event, the electrical lines 50 to 54 are provided within the external diameter of the pipe 1. Furthermore, it is feasible to embody the nozzle assembly connections to the fuel duct 3 and to the nozzle 4 in such a manner that the internal thread 7 of the connecting member 8 is replaced by an external thread.

We claim:

1. A fuel oil burner with fuel heater and electromagnetic valve comprising:

a pipe member having an external diameter, a pipe first end portion adjacent a fuel feed duct, and a pipe second end portion adjacent a nozzle, there being an intermediate member on the pipe member proximal the pipe first end portion;

a first connection member for connecting said first end portion with said fuel feed duct;

a second connection member for connecting said second end portion with said nozzle;

means for conducting fuel through said pipe member;

an electric preheater for heating the fuel in said means for conducting the fuel;

an electromagnetic stop valve having a magnetic coil, said electromagnetic stop valve being provided at said means for conducting the fuel, said preheater being disposed between said first connection member and said electromagnetic stop valve;

electrical contacts, associated with said preheater and said stop valve, located at said intermediate member adjacent said first connection member; and electrical connections from said electrical contacts to said stop valve, said electrical connections being arranged within the external diameter of said pipe member, said electrical connections being located in the pipe member coextensively adjacent with but exteriorly of the preheater.

2. A fuel oil burner as claimed in claim 1, wherein the means for conducting the fuel comprises a number of channels in the preheater.

3. A fuel oil burner as claimed in claim 2, wherein the electromagnetic stop valve extends into the second connection member.

4. A fuel oil burner as claimed in claim 1, wherein the electrical contacts are arranged in a housing proximal the intermediate member.

5. A fuel oil burner as claimed in claim 1, wherein a common protective contact is provided for the preheater and the stop valve.

6. A fuel oil burner as claimed in claim 5, wherein a common return wire contact is provided for the preheater and the stop valve.

7. A fuel oil burner as claimed in claim 6, wherein said magnetic coil of the stop valve is employed for heating the fuel oil in an operation state of the burner.

8. A fuel oil burner as claimed in claim 1, wherein the preheater is detachably mounted to the intermediate member.

9. A fuel oil burner as claimed in claim 1, wherein the pipe member is comprised of a ferromagnetic material at least in the vicinity of the stop vane.

10. A fuel oil burner as claimed in claim 9, wherein at least one elongate heat conducting member is provided substantially enclosing the stop vane, said member extending at a first portion thereof, at least into the vicinity of the preheater and, at an opposite end portion, at least into the vicinity of the nozzle.

11. A fuel oil burner as claimed in claim 10, wherein said pipe first end portion adjacent the fuel feed duct is provided with a filter, said filter being exchangably connected to a carrier member.

12. A fuel oil burner as claimed in claim 11, wherein said carrier member is provided with at least two nut faces.

13. A fuel oil burner with fuel heater and electromagnetic vane comprising:

an elongated pipe member having a fixed external diameter and an inner wall surface;

an intermediate member received in a first end of said pipe member;

a nozzle assembly carried on an opposite second end of the pipe member;

a connector connecting said intermediate member to a fuel feed duct, there being duct means for communicating fuel from said fuel feed duct through said pipe member to the nozzle assembly;

an electric fuel preheater extending axially a distance within the pipe member from the intermediate member;

an electromagnetic stop vane carried in the pipe member proximal the nozzle assembly;

electrical contacts associated with the preheater and the stop vane carried in a housing located on said pipe member on an outer surface thereof; and electrical wire connections extending from said electrical contacts to and coextensively with said preheater and to said stop valve, said electrical wire connections being disposed within the pipe member intermediate said inner wall surface of the pipe member and an external expanse of the preheater.

* * * * *